US007014504B2

(12) United States Patent
Boischio

(10) Patent No.: US 7,014,504 B2
(45) Date of Patent: Mar. 21, 2006

(54) ELECTRICAL CONNECTOR FOR WINDING IN COILS

(75) Inventor: Ido Boischio, Padua (IT)

(73) Assignee: Inarca S.p.A., Vigodarzere (IT)

( * ) Notice: Subject to any disclaimer, the term of this patent is extended or adjusted under 35 U.S.C. 154(b) by 0 days.

(21) Appl. No.: 11/086,295

(22) Filed: Mar. 23, 2005

(65) Prior Publication Data

US 2005/0208830 A1 Sep. 22, 2005

(30) Foreign Application Priority Data

Mar. 17, 2004 (IT) ..... PD20040026 U

(51) Int. Cl.
*H01R 13/40* (2006.01)

(52) U.S. Cl. ..... 439/590

(58) Field of Classification Search ..... 439/590, 439/596, 937, 598, 594
See application file for complete search history.

(56) References Cited

U.S. PATENT DOCUMENTS

| | | | | |
|---|---|---|---|---|
| 4,609,246 | A * | 9/1986 | Ustin et al. | 439/590 |
| 4,611,868 | A * | 9/1986 | Matsui et al. | 439/590 |
| 4,767,353 | A * | 8/1988 | Hughes et al. | 439/398 |
| 5,772,480 | A * | 6/1998 | Yamamoto et al. | 439/885 |
| 6,059,613 | A * | 5/2000 | Feher et al. | 439/713 |
| 6,089,914 | A * | 7/2000 | Piovesan | 439/590 |
| 6,685,507 | B1 * | 2/2004 | Piovesan | 439/596 |

* cited by examiner

*Primary Examiner*—Phuong Dinh
(74) *Attorney, Agent, or Firm*—Modiano & Associati; Daniel O'Byrne; Albert Josif

(57) ABSTRACT

An electrical connector for winding in coils, comprising a box-like shell and a corresponding closure cover that is connected monolithically in a cantilevered fashion, by means of a flexible connection, to an end edge of the box-like shell. The box-like shell forms inside it at least one receptacle for accommodating a corresponding electrical terminal. The electrical connector comprises at least one retention tooth, formed on the end portion of the box-like shell, which can be coupled to a complementary engagement receptacle formed on the cover of a similar connector in order to provide a series engagement for winding in coils.

5 Claims, 3 Drawing Sheets

ELECTRICAL CONNECTOR FOR WINDING IN COILS

BACKGROUND OF THE INVENTION

To facilitate and automate the assembly of electrical connections of electric/electronic components of a generic machine or device, connectors for accommodating electrical terminals to be connected to electrical connection wires are currently being used increasingly.

In particular, connecting assemblies thus formed are used in wiring to be mass-produced.

For this purpose, wiring machines are commercially available which automatically connect the electrical wires and the metallic terminals.

To allow wiring machines to work adequately, they must be fed with connectors and corresponding terminals in the simplest and most effective possible manner.

Feeding individual connectors was found immediately to be inadequate for wiring machines, both because of problems related to solving the dynamics of feeding and because these machines require a continuous feed stream at a very high rate.

Accordingly, the production of "packs" constituted by a plurality of connectors arranged mutually side by side in succession on hollow elongated supports has been provided.

However, this solution is less than ideal, due to the rigidity of the packs and to the difficulties encountered in handling them.

In order to obviate the drawbacks of feeding the "packs" of connectors in automatic machines (and the high costs of the product), coils have been provided which are constituted by a plurality of mutually connected connectors.

The solutions have been orientated toward the lateral connection of the connectors, in practice obtaining all the electrical terminals in series.

For example, the connection has been obtained by connecting the sides of the covers of the connectors by means of complementary male and female tabs (reference should be made, for example, to U.S. Pat. No. 6,685,507).

Another type of connection is provided by means of monolithic straps between sides of contiguous connectors: in practice, monolithic chains of connectors linked by flexible straps are provided, said straps being cut when it is necessary to apply the connector to a user device (reference should be made, for example, to U.S. Pat. No. 6,089,914).

SUMMARY OF THE INVENTION

The aim of the present invention is to provide an electrical connector for winding in coils for feeding wiring machines adequately and effectively.

Within this aim, an object of the present invention is to provide a connector which, when joined in series to others, can be separated easily and rapidly.

Another object of the present invention is to provide a connector whose application to the wiring operation can be automated substantially completely.

Another object is to provide a connector that can be arranged in series in coils for feeding wiring machines, so that the connectors of said series are sufficiently flexible with respect to each other and at the same time are mutually connected stably and safely.

Another object of the present invention is to provide a connector that is economically competitive to manufacture with respect to known connectors and can be manufactured with known technologies.

This aim and these and other objects that will become better apparent hereinafter are achieved by an electrical connector for winding in coils, which comprises a box-like shell that is open at two opposite ends, respectively a first end and a second end, and a corresponding closure cover that is connected monolithically in a cantilevered fashion, by means of a flexible connection, to an edge of said first end of said box-like shell, said box-like shell forming inside it at least one receptacle for accommodating a corresponding electrical terminal, said electrical connector being characterized in that it comprises at least one retention tooth, formed on the end portion of the box-like shell that is related to said first end, which can be coupled to at least one complementary engagement receptacle formed on the upper closure cover of a similar connector in order to provide a series engagement for winding in coils.

BRIEF DESCRIPTION OF THE DRAWINGS

Further characteristics and advantages of the present invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
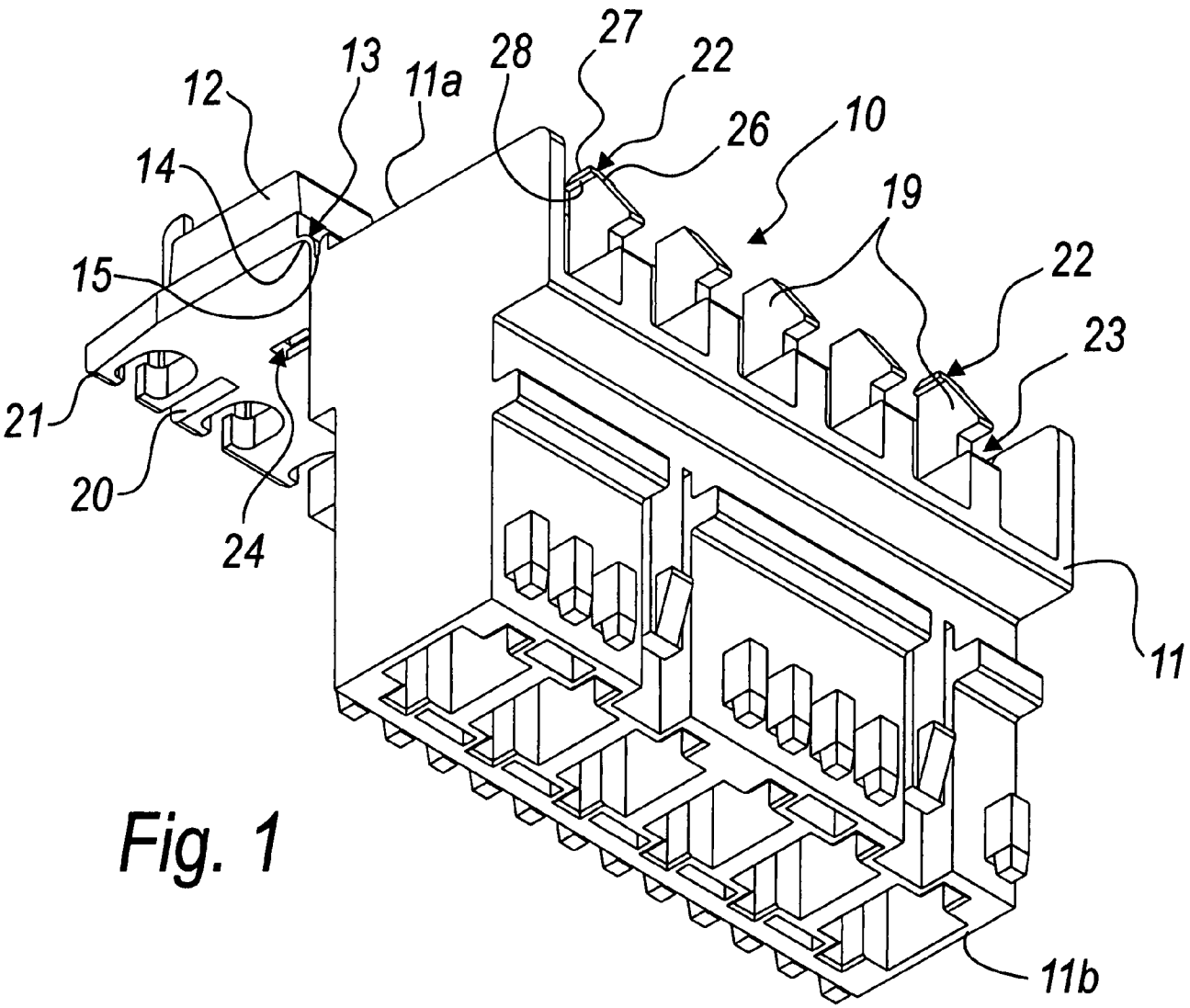
FIG. 1 is an axonometric view of a connector according to the invention.

With reference to the figures, an electrical connector for winding in coils according to the invention is generally designated by the reference numeral 10.

The electrical connector 10 comprises a box-like shell 11, which is open at two mutually opposite ends (respectively a first end 11*a* and a second end 11*b*), and a corresponding closure cover 12, which is connected monolithically in a cantilevered fashion by way of a flexible connection 13, such as for example a flexible strap 14, to an upper rear edge 15 of the box-like shell 11.

Figure 2:
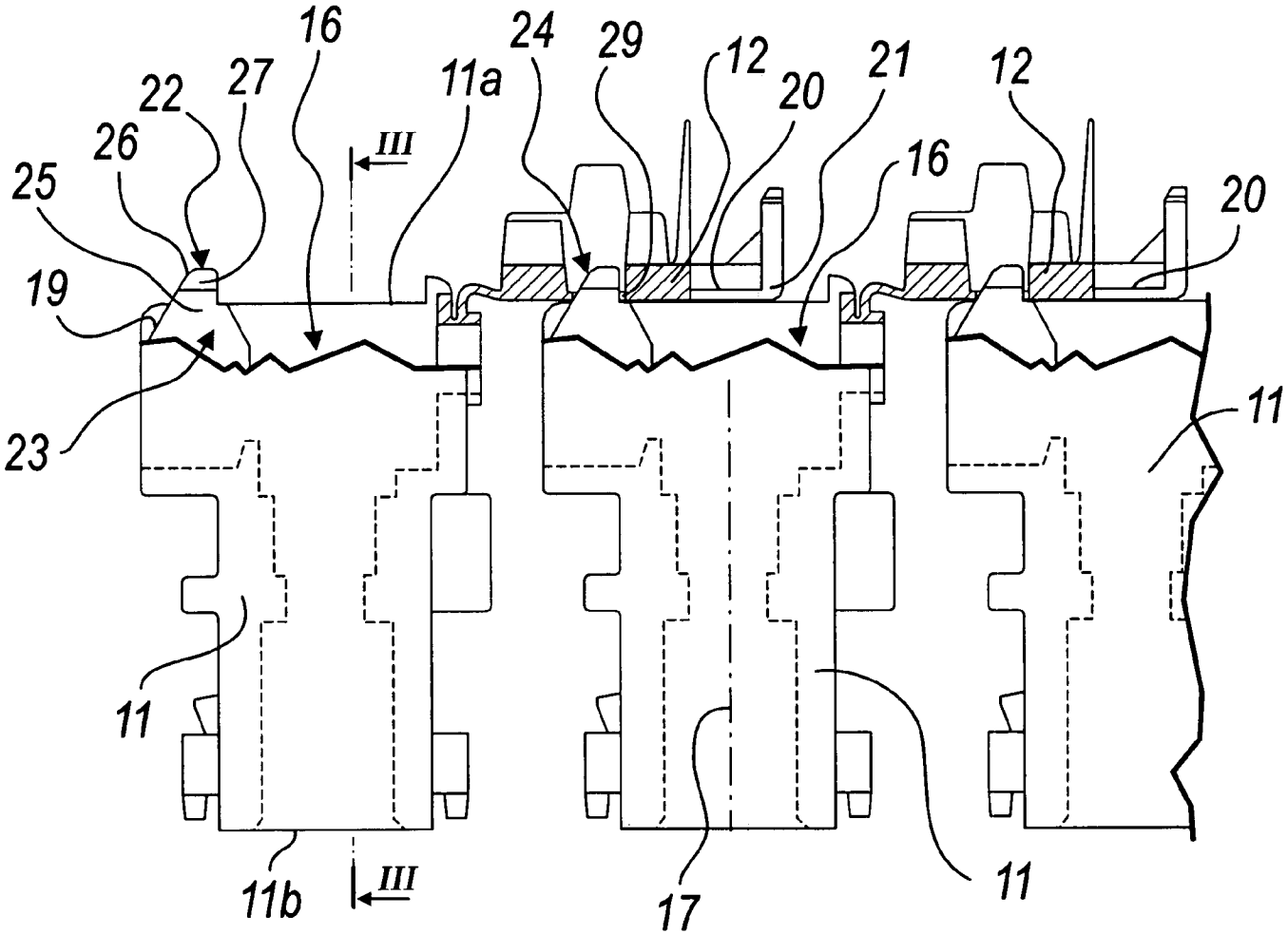
FIG. 2 is a partially sectional side view of a plurality of connectors according to the invention, connected in series.
Figure 3:
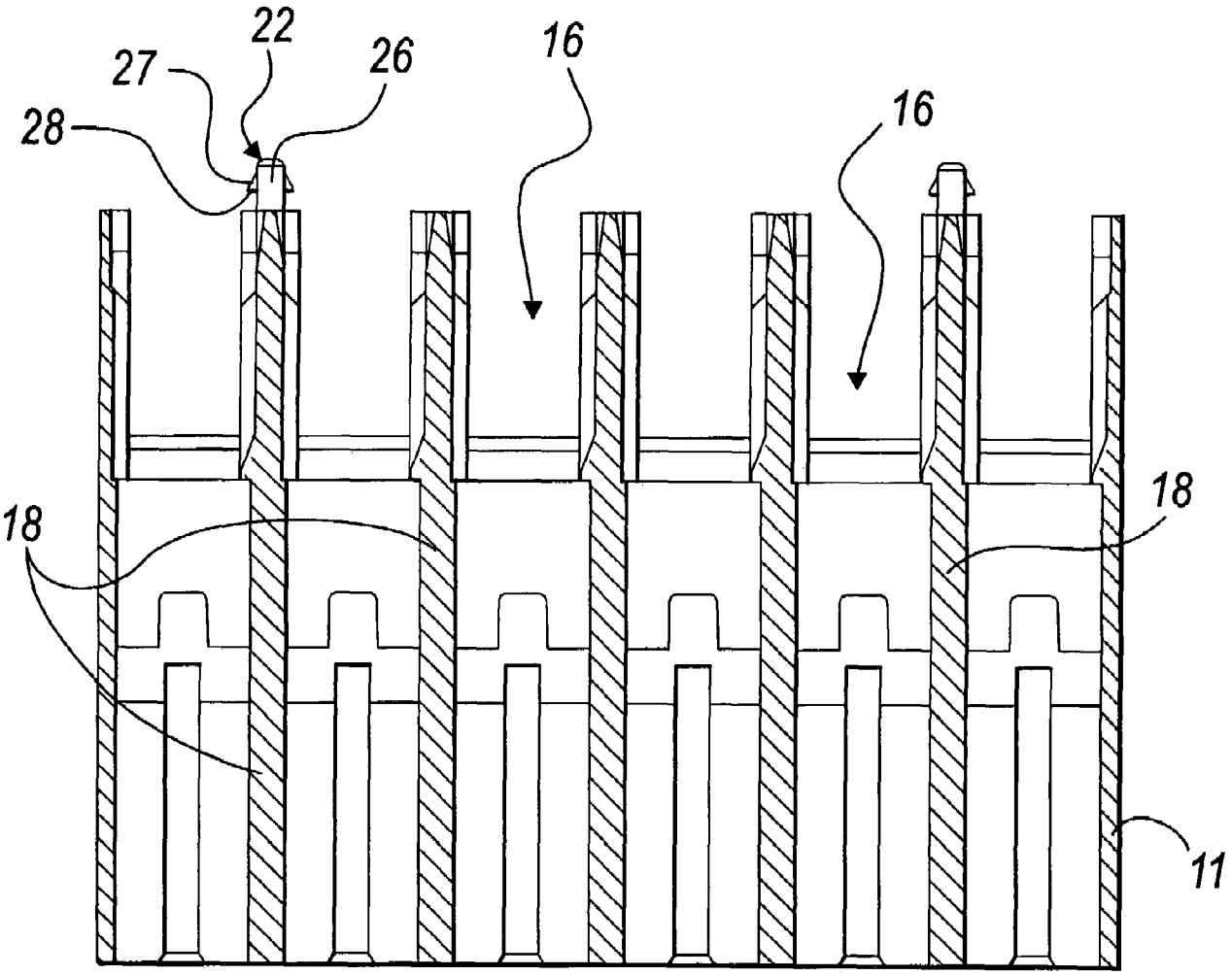
FIG. 3 is a front sectional view of a connector according to the invention, taken along the line III—III of FIG. 2.

The box-like shell 11 forms internally receptacles 16 for accommodating a corresponding electrical terminal 17, which is shown schematically for example in FIG. 2 by means of its main longitudinal axis.

The number of receptacles 16 is variable, depending on the use of said connector, from one to "n"; for example, in the embodiment shown in the figures, the box-like shell 11 forms six receptacles 16.

The receptacles 16 are substantially separated by dividing walls 18.

Engagement teeth 19 are formed on the end portions of the dividing walls 18, in front of the shell 11, and can be coupled detachably to complementary retention receptacles 20 formed on the front edge 21 of the cover 12, which are designed to keep the cover 12 closed.

The cover, when open, is substantially turned backward through approximately 180° with respect to the flexible strap 14.

The connector 10 further comprises retention teeth 22, which are formed on the end portion (related to the first end 11*a*), generally designated by the reference numeral 23, of the box-like shell 11.

The retention teeth 22 can be coupled to complementary engagement receptacles 24 formed on the cover 12 of a similar connector in order to provide a series engagement for winding said connectors in coils.

In particular, the retention teeth 22 are formed on the end portion 25 of some engagement teeth 19; in this embodiment, they are provided on the two mutually opposite terminal engagement teeth 19.

Each retention tooth 22 has a front part 26, which is inclined substantially as a continuation of the corresponding engagement tooth 19, and lateral parts 27, which are inclined and form undercuts 28 for locking on the complementary engagement receptacle 24.

The engagement receptacle 24 is constituted by a rectangular slot 29 that passes through the thickness of the cover 12.

Said slot is narrower than the width of the retention tooth 22: insertion in the engagement receptacle 24 on the part of the corresponding retention tooth 22 therefore occurs by elastic deformation.

In practice it has been found that the invention thus described achieves the intended aim and objects; in particular, the present invention provides an electrical connector for winding in coils, which allows front-to-back connection of similar connectors, so as to provide a plurality of connectors to be arranged in coils in order to feed wiring machines.

It should be noted that connecting the connectors by coupling covers with box-like shells allows to obtain excellent mutual flexibility for winding in coils, utilizing in practice the flexibility of the strap for connecting the cover and the shell.

The coupling between the retention teeth and the engagement receptacles of adjacent connectors allows easy (yet safe) mutual engagement of the connectors, that form a connector series suitable for coiling, the coils obtained being usable for feeding wiring machines.

It should also be noted that the provision of the retention teeth and of the engagement receptacles entails extremely limited shape changes of the connectors (with respect to connectors without mutually connecting elements), with minimal intervention on the molds.

Moreover, the space occupation of connectors according to the invention is the same as that of connectors without mutual connecting elements, and this is not the case for connectors for arrangement in coils that are connected laterally by means of tabs or straps (said straps must be cut in order to install the connector).

In practice, the materials employed, so long as they are compatible with the specific use, as well as the dimensions, may be any according to requirements and to the state of the art.

The disclosures in Italian Patent Application No. PD2004U000026 from which this application claims priority are incorporated herein by reference.

What is claimed is:

1. An electrical connector for winding in coils, comprising: a box-shaped shell that is open at a first end and a second opposite end thereof; a corresponding closure cover provided with a flexible connection, said cover being monolithically connected in a cantilevered fashion, by way of said flexible connection, to an edge of said first end of said box-shaped shell; at least one receptacle formed inside said box-shaped shell; one electrical terminal accommodated in said receptacle; at least one retention tooth, formed at an end portion of the box-shaped shell that is related to said first end thereof; and at least one complementary engagement receptacle formed on the closure cover so that the electrical connector is connectable with a similar electrical connector by coupling of said engagement receptacle to a retention tooth of the similar electrical connector in order to provide a series connector engagement for winding in coils.

2. The electrical connector of claim 1, comprising: two receptacles divided by a dividing wall; an engagement tooth formed on an end portion of the dividing wall being detachably associable with said complementary retention receptacle; and a complementary retention receptacle formed on a front edge of said upper closure cover being formed on a tip portion of said engagement tooth.

3. The electrical connector of claim 2, wherein said at least one retention tooth has an inclined front part and inclined side parts, which form undercuts for locking on said complementary engagement receptacle.

4. The electrical connector of claim 3, wherein said engagement receptacle is constituted by a slot that passes through a thickness of said cover and is narrower than said retention tooth, said engagement receptacle being insertable on said corresponding retention tooth of a similar electrical connector by elastic deformation.

5. A series of electrical connectors for winding in coils, wherein each one of said electrical connectors comprises: an electrical connector for winding in coils, comprising: a box-shaped shell that is open at a first end and a second opposite end thereof; a corresponding closure cover provided with a flexible connection, said cover being monolithically connected in a cantilevered fashion, by way of said flexible connection, to an edge of said first end of said box-shaped shell; at least one receptacle formed inside said box-shaped shell; one electrical terminal accommodated in said receptacle; at least one retention tooth, formed at an end portion of the box-shaped shell that is related to said first end thereof; and at least one complementary engagement receptacle formed on the closure cover so that the electrical connector is connectable with a similar electrical connector by coupling of said engagement receptacle to a retention tooth of the similar electrical connector.

* * * * *